US005259591A

United States Patent [19]

Ramaseder et al.

[11] Patent Number: 5,259,591

[45] Date of Patent: Nov. 9, 1993

[54] METHOD FOR INSTALLING AND REMOVING A LANCE INTO AND FROM A METALLURGICAL VESSEL

[75] Inventors: Norbert Ramaseder, Linz; Hubert Öllinger, St. Veit, both of Austria

[73] Assignee: Voest-Alpine Industrieanlagenbau GmbH, Linz, Austria

[21] Appl. No.: 935,533

[22] Filed: Aug. 25, 1992

Related U.S. Application Data

[62] Division of Ser. No. 648,651, Jan. 31, 1991, Pat. No. 5,200,136.

[30] Foreign Application Priority Data

Feb. 2, 1990 [DE] Fed. Rep. of Germany ..... 4003068

[51] Int. Cl.[5] ..... C21C 5/30

[52] U.S. Cl. ..... 266/44; 75/375; 75/376

[58] Field of Search ..... 266/79, 99, 135, 226, 266/44; 75/375, 376

[56] References Cited

U.S. PATENT DOCUMENTS

| | | | |
|---|---|---|---|
| 4,226,407 | 10/1980 | Reinbold | 266/226 |
| 4,637,592 | 1/1987 | La Bate et al. | 266/272 |
| 4,747,582 | 5/1988 | Bergstrom et al. | 266/226 |
| 4,792,124 | 12/1988 | Zonneveld | 266/79 |

FOREIGN PATENT DOCUMENTS

| | | |
|---|---|---|
| 0079290 | 11/1982 | European Pat. Off. . |
| 2738291 | 3/1979 | Fed. Rep. of Germany . |
| 87385 | 11/1988 | Luxembourg . |
| 870442 | 10/1981 | U.S.S.R. . |

OTHER PUBLICATIONS

Patent Abstracts of Japan, Band 8, Nr. 110 (C-224) [1547], 23 May 1984; JP-A-59 023810 (Nihon Supingu K. K.) Jul. 2, 1984.

*Primary Examiner*—Melvyn J. Andrews

*Attorney, Agent, or Firm*—Hopgood, Calimafde, Kalil, Blaustein & Judlowe

[57] ABSTRACT

An arrangement for introducing and removing a lance into and out of a tiltable metallurgical vessel has drive means stationarily arranged in the direction of the lance axis and means for pivotal mounting of the drive means. The lance is designed as a guide and is guided by the drive means and is movable in the direction of its axis. In a method using the above arrangement for positioning the lance relative to the metallurgical vessel, the actual position of the vessel is taken up by a position transmitter on said vessel, and the drive means is actuated to position the lance in dependence on that actual position.

1 Claim, 3 Drawing Sheets

METHOD FOR INSTALLING AND REMOVING A LANCE INTO AND FROM A METALLURGICAL VESSEL

This application is a division of copending application Ser. No. 07/648,651, filed Jan. 31, 1991 now U.S. Pat. No. 5,200,136.

The invention relates to an arrangement for installing and removing a lance, in particular a measuring and/or sampling lance, into and from a tiltable metallurgical vessel, in particular a steel works converter, wherein the lance is designed as a guide and is guided by a drive stationarily arranged in the direction of the axis of the lance and is movable in the direction of its axis, the drive being mounted so as to be pivotable.

Installations for installing and removing a lance have been known from DE-C-27 39291 and EP-A-0 079 290. With these two known installations, the lance is insertable into the metallurgical vessel through an opening especially provided for this purpose in the wall of the metallurgical vessel, the lance being mounted with its upper end at a lance carriage that is movable along rails arranged beside the converter, the length of the rails corresponding to the length of the lance.

For alignment of the lance with the opening in the side wall of the metallurgical vessel, the guide for the lance carriage is displaceable or tiltable relative to the metallurgical vessel. This requires complex means, because the guide for the lance carriage is heavy due to its great length and must be built accordingly stable to avoid oscillations of the lance. The guide for the lance carriage and its support on the carrying structure of the steel works hall requires a considerable amount of space laterally of the converter, which makes other manipulations, such as slipping a probe onto the lance or taking it off the lance, difficult to carry out.

Movement of the known lance carriages along their guides is effected by means of rope winches or chain hoists. This involves the danger of a rope of chain break causing damage to lance and metallurgical vessel.

An installation of the initially defined kind is known from U.S. Pat. No. 4,637,592. In this installation, an arrangement for retaining slag is pivotable into a converter and installable in a tap hole from within the converter interior. The arrangement is fastened to the end of a lance, and the lance is displaceably inserted in a sleeve that is provided with a drive. The sleeve in turn is pivotably mounted on a stationary supporting structure.

With this known, installation difficulties may arise if the tap hole of the metallurgical vessel does not always assume the same position after tilting of the vessel, such as occurs due to tooth flank play or after a certain wear of a tilting drive tilting the metallurgical vessel and provided with toothed wheels.

The invention aims at avoiding these disadvantages and difficulties and has as its object to design an installation of the initially defined kind such that it requires only little space and is very safe to operate. Despite a simple construction, the installation is to be particularly stable. In particular, the installation is to enable a precise adjustment of the lance position relative to the metallurgical vessel with inexpensive means of simple construction, even in case the metallurgical vessel does not always assume exactly the same position after a tilting procedure.

According to the invention, this object is achieved in that the drive is mounted so as to be pivotable about two axes crossing each other.

According to a preferred embodiment, the drive is designed as a frictional wheel drive. This guarantees a problem-free movement of the lance in the axial direction, this being so even if the lance is contaminated. Should a failure still occur, e.g. due to an accumulation of slag, the frictional wheel drive, which constitutes a kind of safety sliding clutch, is not negatively affected, and after release of the frictional engagement of the drive wheels, the lance can be pulled out of the metallurgical vessel, e.g. by means of a crane. After cleaning of the lance the installation is immediately ready for use.

Another preferred embodiment is characterised in that the drive is movable, preferably in the direction perpendicular to the axis of the lance, approximately in the horizontal direction. The displaceability also serves for adapting the position of the lance axis to the opening of the metallurgical vessel. Furthermore, it may serve to bring a further lance, arranged beside the measuring lance, for a second sampling or second measurement in alignment with the opening of the metallurgical vessel, or it may also serve to push a clearing device through the opening of the metallurgical vessel prior to effecting the measurement or sampling, to thereby clean the opening from slag or other deposits, so that no damage can occur at the probes slipped onto the free end of the lances when effecting the measurement or sampling. Displaceability of the drive may also be advantageous if the lance is to be introduced into differently arranged openings of the same metallurgical vessel or is to be introduced into different metallurgical vessels.

Preferably, a further drive for a further device insertable into the metallurgical vessel, such as a cleaning means, is provided beside the drive for the lance for this purpose.

For ensuring a perfect operation of the lance in the rough steel works operation, the drive is suitably surrounded by a housing, at whose passage opening facing the metallurgical vessel and provided for the lance or, if a further device is present, for that device, a scraping means for cleaning the lance or the further device is provided.

A preferred, particularly sturdy variant is characterised in that horizontally extending rails are provided on a stationary supporting structure, along which a carrying plate is displaceably guided, a base plate being mounted to the carrying plate so as to be pivotable about an axis extending perpendicular to the carrying plate, on which base plate at least one housing accommodating a drive for the lance or in case of the presence of a further device, a drive for the further device is mounted so as to be pivotable about an axis oriented parallel to the guide rails, a displacement means for moving the carrying plate relative to the stationary supporting structure, a pivot means for pivoting the base plate relative to the carrying plate, and a further pivot means for pivoting the housing relative to the base plate being provided.

To avoid falling down of the lance in case of a failure of the drive, advantageously a braking means is provided in the housing for braking and fixing the lance, or in case of the presence of a further device, for braking and fixing the further device relative to the housing.

Advantageously, the lance is designed to be hollow, and the cavity of the lance is connected to a gas supply duct.

According to a preferred embodiment, in the interior of the hollow lance there is further provided a protecting tube for measuring cables arranged in the interior of the lance, the protecting tube suitably being connected to a gas supply duct.

A preferred structure is characterised in that the frictional wheel drive is formed by two pairs of frictional wheels, wherein one pair of frictional wheels each supports the lance at two opposing sides and at least one frictional wheel of a pair of frictional wheels is drivable and this frictional wheel and/or the oppositely arranged frictional wheel of this pair of frictional wheels is pressable against the lance.

Advantageously, the frictional wheel drive is formed by at least three frictional wheels, at least one of which is drivable and at least one is pressable against the lance.

A method of positioning a lance relative to an opening of a tiltable metallurgical vessel, in particular a steel works converter, is characterised in that the actual position of the metallurgical vessel is sensed by means of a position transmitter arranged on the vessel and a drive means is actuated for positioning the lance in dependence on the sensed actual position.

Suitably, the position of the lance is determined by position sensors, i.e. by a distance sensor determining the position of the carrying plate, an angle sensor determining the angular position of the base plate relative to the carrying plate, and an angle sensor determining the angular position of the housing relative to the base plate, and the values of the position transmitter of the metallurgical vessel are fed to a calculator, and the latter controls the drive means for the lance, i.e. the displacement means, the pivot means and the further pivot means, i.e. until the position sensors allocated to the lance indicate the coincidence of the position of the lance and the position of the opening of the metallurgical vessel.

The invention will now be explained in more detail by way of the accompanying drawings and an exemplary embodiment, wherein FIG. 1 is a side view of the installation according to the invention with the lance in the retracted position, and FIG. 2 is a partially sectioned view in the direction of the arrow II of FIG. 1.

Figure 1:
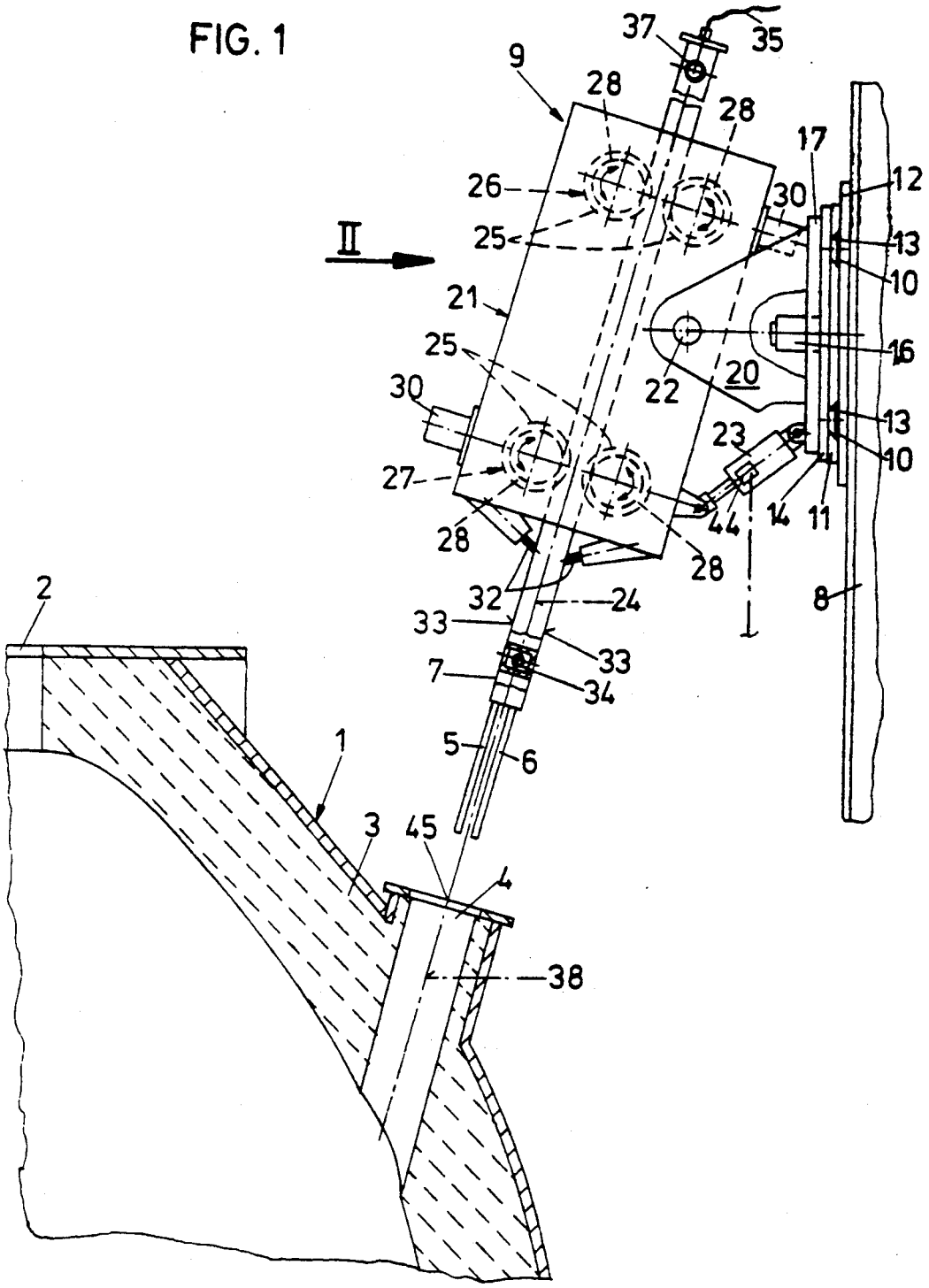

In the drawings, a steel works converter 1 is illustrated in section, the plane of the section extending through the longitudinal axis of the converter and its tilting axis. The mouth of the converter is denoted by 2. During tilting of the converter 1 it can be moved along a circular are, perpendicular to the plane of drawing or section.

In the wall 3 of the converter 1, a passage opening 4 for introducing a lance 7 equipped with a measuring 5 and/or sampling probe 6 is provided in the vicinity of the mouth 2. The lance 7 may also be designed as a supply means for charging additives. An installation 9 serves for introducing and removing the lance 7, which installation is arranged on a stationary supporting structure, e.g. a hall structure 8, and is designed as follows:

On the supporting structure 8 there are provided stationary, approximately horizontally extending rails 10, which, in the exemplary embodiment illustrated, are designed as dovetail-shaped grooves. These grooves 10 are provided in a supporting plate 11, which is mounted on the ball structure via an understructure 12. A carrying plate 14, which is provided with dovetail-shaped guide lodges 13 on its rear side is displaceable along the grooves 10, the guide ledges 13 protruding into the grooves 10. A pressure medium cylinder 15 mounted on the carrying plate 14, on the one hand, and on the understructure 12, on the other hand, serves for displacement.

On the carrying plate 14 a pivot pin 16 directed perpendicular thereto is provided. On this pivot pin 16 a base plate 17 arranged parallel to the carrying plate is pivotably mounted. As the pivot drive, a pressure medium cylinder 18 is provided, which is hinged to a projection 19 of the base plate 17, on the one hand, and to the carrying plate 14, on the other hand. The base plate 17 is equipped with two spaced apart and parallel brackets 20 extending approximately perpendicular to the base plate 17 towards the front. Between these brackets 20, a housing 21 is inserted and pivotably mounted on the brackets 20 via pivot pins 22. Here, too, a pressure medium cylinder 23 is provided as the pivot drive for the housing 21, which pressure medium cylinder is hinged to the base plate 17, on the one hand, and to the housing 21, on the other hand. The axis of the pivot pine 22 and the axis of the pivot pin 16 need not intersect; they may also cross at a distance from each other, i.e. be skew to each other.

According to the exemplary embodiment illustrated, the housing 21 is designed in two parts, two wheel pairs 26, 27, spaced apart in the direction of the longitudinal axis 24 of the lance 7 and formed by frictional wheels 25 being provided in each part of the housing 21. The frictional wheels 25 are designed with lateral guiding beads 28. The frictional wheels 25 of a first part of the housing 21 are in frictional engagement with a lance 7, the frictional wheels 25 provided in the other part of the housing 21 are in frictional engagement with a clearing device 29 provided for cleaning the passage opening 4 of the converter 1 before sampling or measuring are effected, so that the sampling 6 or measuring probe 5 provided on the lance 7 are not damaged during their introduction into the converter 1.

Each pair 26, 27 of frictional wheels has a frictional wheel 25 drivable by means of a motor 30 and a frictional wheels 25 pressable against the second frictional wheel 25, e.g. by means of springs, so that the lance 7 and the clearing device 29 are each securely held and moved by both pairs 26, 27 of frictional wheels.

As can be seen from FIG. 1, the motors 30 for driving the frictional wheels are arranged relative to the center of the housing 21 such that the weight of the housing 21 is as balanced as possible. In the interior of the housing 21 there are braking jaws 31 for securing the lance and the clearing device 29, in case of an operational standstill. All the drives for displacing and pivoting the housing 21 and the motors for driving the frictional wheels or the brakes may be set into operation either electromechanically or by means of a pressure medium.

Figure 3:
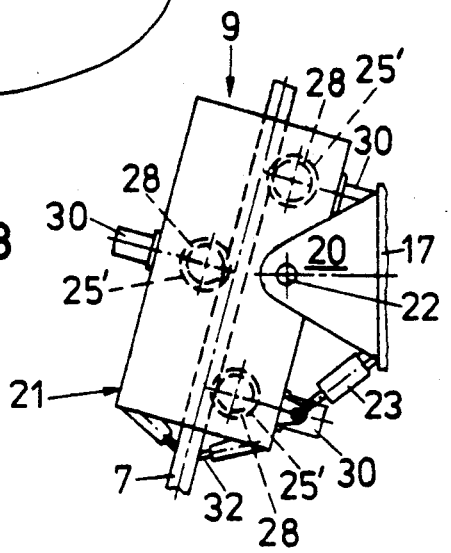
FIG. 3 is a schematic illustration of a variant of the lance drive.

As can be seen from FIG. 3, also three frictional wheels 25' may be provided instead of the two above-described pairs of frictional wheels. However, the drive may also be effected by means of a toothed wheel engaging into a toothed rack provided at a side of the lance 7.

On the lower front side of the housing 21 there are slag scraping means 32, which clean the sides 33 of the lance 7 and the clearing device 29 getting into contact with the frictional wheels 25 at least to such an extent that perfect frictional engagement with the frictional wheels 25 without impairing the movement of the lance 7 and of the clearing device 29 is safeguarded.

The lance 7 itself is formed by a hollow square, multiple-cornered or round steel tube. At the tip of the lance there are receiving attachments for the measuring 5 or sampling probes 6, the number of the attachments depending on the type of operation desired, also several measurements or samplings being simultaneously feasible.

At the center of the lance 7 a protecting tube 34 for measuring cables 35 is provided. Both, the protecting tube 34 and the lance 7 itself may be flushed with flush gas, e.g. nitrogen, for which purpose the gas supply ducts 36, 37 provided on the upper end of the lance 7 serve. By flushing the protecting tube 34, the contacts between the measuring cables 35 and the probe may be kept clean. The lance 7 itself is flushed with a larger amount of gas only during movement into the converter, so as to cool the lance.

On account of the housing 21 being displaceable and pivotable, an exact adaptation of the axis 24 of the lance 7 to the axis 38 of the passage opening 4 is feasible, so that the introduction and removal of the lance 7 or of the clearing device 29, respectively, may occur without any problems. This is particularly important if the metallurgical vessel 1 is tiltable, as in the exemplary embodiment illustrated. Because of the tilting drive provided for tilting and equipped with toothed wheels, the position of a metallurgical vessel 1 intended for carrying out the measurement cannot be exactly determined. This is due to the tooth flank plays and also to a wear of the toothed wheels. The arrangement furthermore makes it possible to reach any desired point within a certain area with the lance tip or with the tip of the clearing device 29, respectively.

In addition to an exact adaptation of the lance axis 24 to the axis 38 of the passage opening 4, the arrangement of the invention may furthermore be used to reach various passage openings 4 at a metallurgical vessel 1 with one and the same lance 7, or to carry out measurements at several adjacently arranged metallurgical vessels 1 with one and the same lance 7.

The light and compact construction due to the omission of a separate lance guide extending over the length of the lance is a particular advantage of the arrangement of the invention. The arrangement of the invention offers a high operational safety, because it is neither possible for a rope to tear or slacken, nor for a chain to break. Furthermore, lance adjustments may be effected within a short span of time, since only short adjustment paths need be passed and, compared to the prior art, only slight masses need be moved.

The arrangement according to the invention is operated as follows:

The lance 7 can be brought into a ready position, an exchange position as well as a measuring position. The ready position is the starting position for reaching the exchange position and the measuring position. In the exchange position, the probe 5, 6 is either automatically or manually exchanged. The three positions can be reached by pressing a button on the control panel.

The control panel includes a button for starting the measurement. If that button is pushed, at first the clearing device 29 is lowered into the passage opening 4 to clean the same from slag residues. Subsequently the clearing device 29 is moved back into its initial position, and the carrying plate 14 is moved until the lance 7 can be lowered through the passage opening 4 into the converter. When the measurement has been effected, the lance 7 returns into the ready position.

Figure 2:
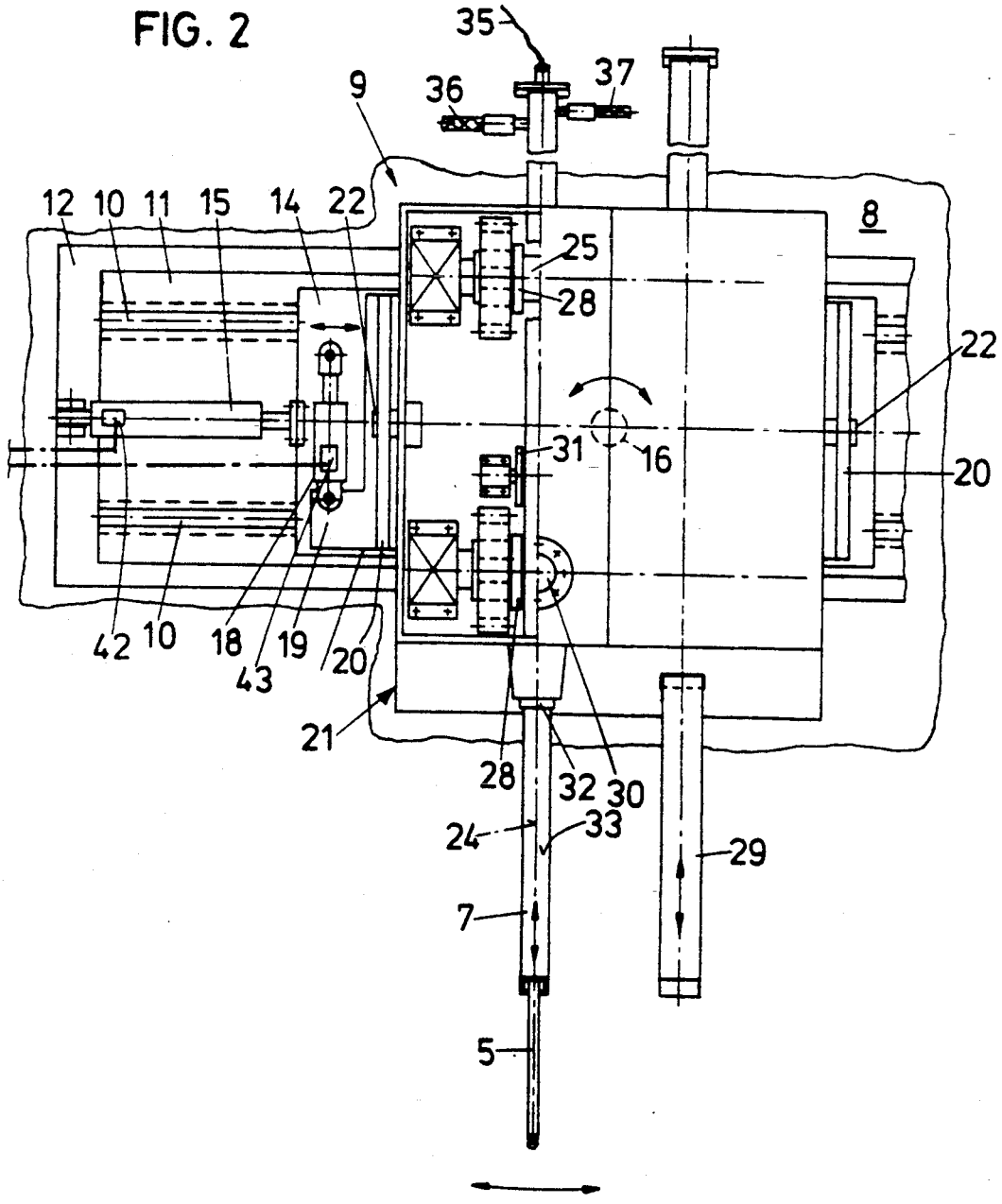
Figure 4:
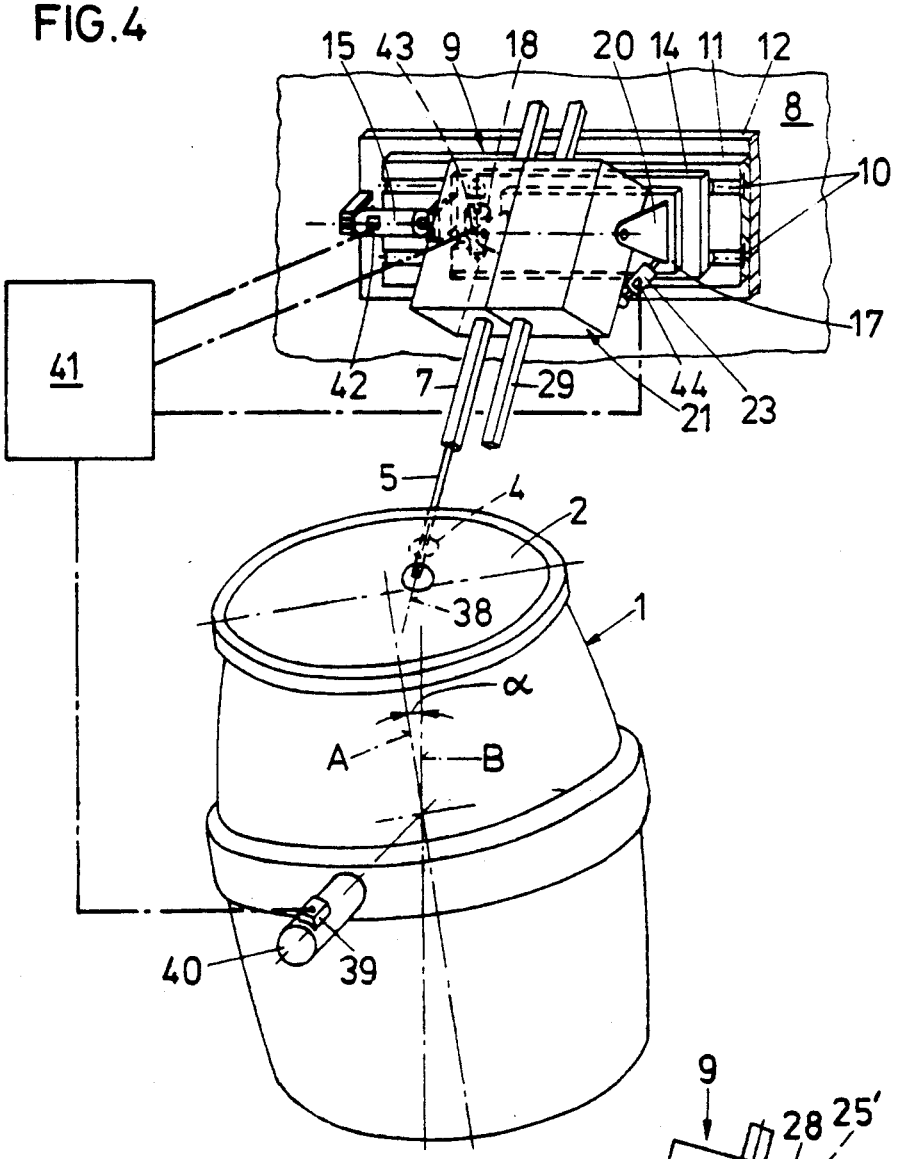
FIG. 4 is a schematic illustration of a method of positioning a lance.

FIG. 4 shows an arrangement as illustrated in FIGS. 1 and 2, wherein this arrangement is, however, equipped with additional installations enabling an automatic adaption of the position of the lance 7 relative to the passage opening 4 of the converter 1. To this end, the converter 1 is equipped with a position transmitter 39 enabling the exact determination of the tilting position of the converter 1, i.e. independently of the tooth flank play of the converter drive. The position transmitter 39 may, e.g., be fixedly mounted on the trunnion 40 of the converter 1. The sensed value or signal of the position transmitter is fed to a calculator 41. With this position transmitter 39, which is designed as an angle sensor, it is thus also possible to determine the position of the axis 38 of the passage opening 4 passing the wall 3 of the converter 1.

FIG. 4 is a schematic and very exaggerated illustration of a deviation of the actual position A of the converter from the vertical set position B, which deviation is caused by a tooth flank play of the converter drive. According to FIG. 4, there are further provided position sensors 42, 43, 44 determining the position of the lance 7, i.e. a distance sensor 42 determining the position of the carrying plate 14, an angle sensor 43 determining the angular position of the base plate 17 relative to the carrying plate 14, and a further angle sensor 44 determining the angular position of the housing 21 relative to the base plate 17. These position sensors 42, 43, 44 suitably are arranged on the drive means 15, 18 and 23 provided for positioning the lance 7. The values sensed by these position sensors 42, 43, 44 are also fed to the calculator 41. This calculator determines those set values which the position sensors 42, 43, 44 must indicate in order that the position of the lance 7 is best adjusted to the position of the passage opening 4, i.e. on the basis of the value determined by the position transmitter 39 which takes up the actual position A of the converter 1. Based on the calculated set values, which the position sensors must indicate, the calculator 41 emits control signals for the drive means 15, 18 and 23 until these set values have been reached. Subsequently introduction of the measuring or sampling lance 7 into the passage opening 4 may be started. If the geometric connections prevent an alignment of the axis 38 of the passage opening 4 with the axis 24 of the lance 7, it suffices to direct—by means of the calculator—the axis 24 of the lance 7 to the center 45 of the entry cross-section of the passage opening 4.

What we claim is:

1. A method of positioning a lance along its axis relative to an opening of a tiltable metallurgical vessel, said lance being designed as a guide and supported by a displaceable drive means stationarily mounted and disposed towards said lance in the direction of the lance axis, said lance being movable along its axis, said drive means being pivotable about two axis which cross each other, said method comprising:

providing a position-sensing transmitter attached to said metallurgical vessel, sensing the position of said metallurgical vessel by means of said transmitter and providing a sensed signal thereof, transmitting said sensed signal corresponding to said sensed position to said drive means, and actuating said drive means in accordance with the position sensed and thereby position said lance relative to the opening in said vessel in cooperating relationship with said vessel.

* * * * *